US005261745A

United States Patent [19]

Watkins

[11] Patent Number: 5,261,745

[45] Date of Patent: Nov. 16, 1993

[54] MIXING APPARATUS WITH FRUSTO-CONICALLY SHAPED IMPELLER FOR MIXING A LIQUID AND A PARTICULATE SOLID

[76] Inventor: James R. Watkins, 3430 Paris Blvd., Westerville, Ohio 43081

[21] Appl. No.: 867,333

[22] Filed: Apr. 13, 1992

[51] Int. Cl.[5] ..... B01F 7/16

[52] U.S. Cl. ..... 366/250; 366/246; 366/251; 366/262; 366/293; 366/305; 366/347; 366/605; 416/231 A

[58] Field of Search ..... 366/65, 97, 98, 197, 366/242-251, 262-265, 270, 279, 281-284, 292, 293, 305, 347, 605; 416/194, 195, 223 B, 231 R, 231 A

[56] References Cited

U.S. PATENT DOCUMENTS

| | | | |
|---|---|---|---|
| 402,976 | 5/1889 | Rudasill | 366/262 X |
| 444,345 | 1/1891 | Gabbett | 366/265 |
| 612,317 | 10/1898 | Dundon | 366/263 |
| 619,811 | 2/1899 | Vernon | 366/262 |
| 2,045,919 | 6/1936 | Parraga | 366/305 |
| 2,190,896 | 2/1940 | Underwood | 366/265 |
| 2,244,814 | 6/1941 | Underwood | 366/265 |
| 2,244,815 | 6/1941 | Underwood | 366/262 |
| 2,254,127 | 8/1941 | Underwood | 366/265 |
| 2,655,436 | 10/1953 | Bishop et al. | 366/265 X |
| 3,162,338 | 12/1964 | Grubelic | 366/347 X |

FOREIGN PATENT DOCUMENTS

| | | | |
|---|---|---|---|
| 1295990 | 5/1962 | France | 366/305 |

*Primary Examiner*—Harvey C. Hornsby
*Assistant Examiner*—Charles Cooley
*Attorney, Agent, or Firm*—Rothwell, Figg, Ernst & Kurz

[57] ABSTRACT

An improved mixing apparatus for mixing a liquid and a particulate solid material within a container such that the pigments and/or other solid particulate materials, which are initially precipitated out and usually accumulated at the bottom of the container, are rapidly and thoroughly mixed and dispersed throughout the liquid in a uniform manner such that substantially all of the particulate material is dispersed within the liquid. In one embodiment, a flow pattern in the form of an inverted vortex rising from the bottom center of the container is created by a rotating frusto-conically shaped impeller to pull the particulate material away from the bottom of the container. In another embodiment, the apparatus includes a cover mechanism, which is made to function integrally with the mixing apparatus, and which covers the container during the mixing operation to prevent the escape of fumes or spray. The cover mechanism is further provided with an access portion which is operable to allow ready access to the interior of the container without removal of the cover mechanism and which permits the taking of samples of the liquid being mixed well as convenient and ready access for other purposes during the mixing operation.

6 Claims, 3 Drawing Sheets

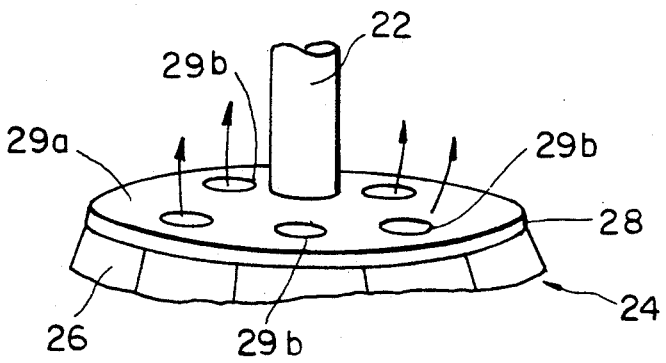
FIG.4A
FIG.5
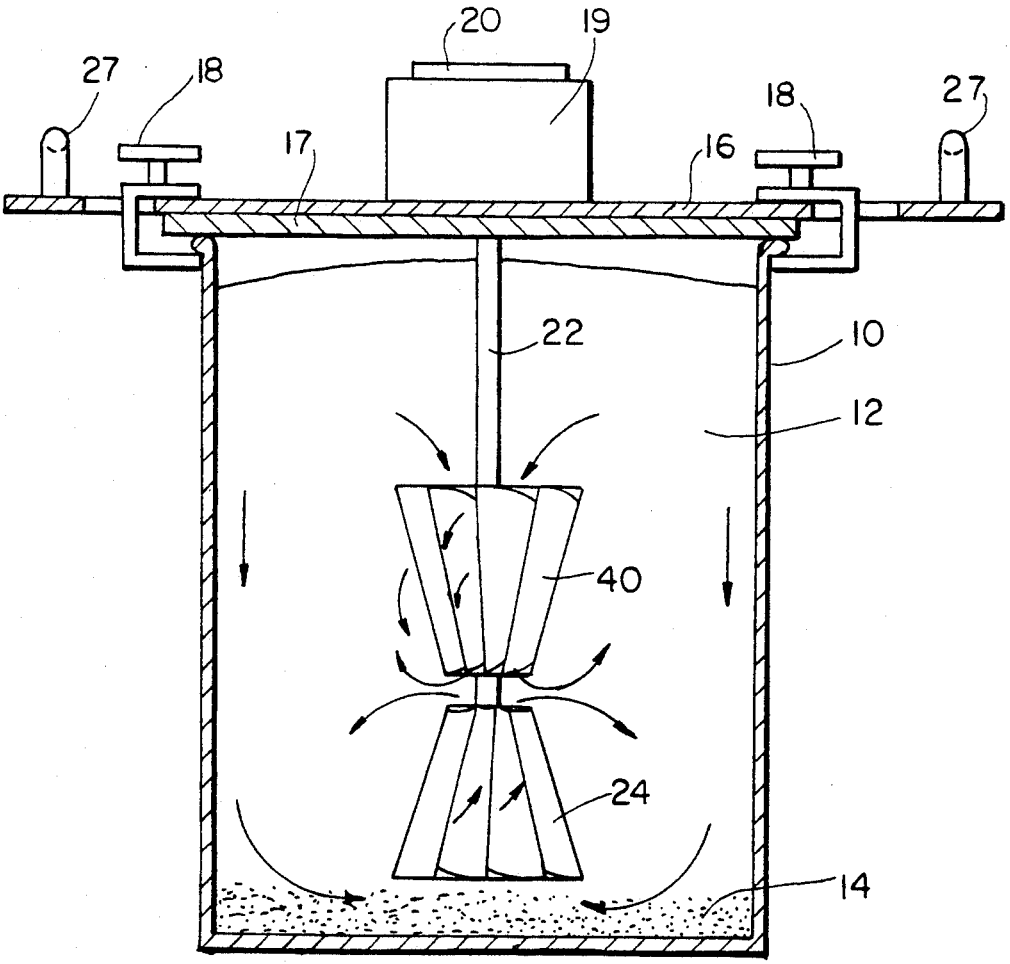

MIXING APPARATUS WITH FRUSTO-CONICALLY SHAPED IMPELLER FOR MIXING A LIQUID AND A PARTICULATE SOLID

The present invention relates to the field of mixing and agitation of liquids, particularly liquids containing solid particulate materials, such as paint pigments and the like, which must be thoroughly dispersed within the liquids in which they are suspended to form emulsions or similar dispersions.

BACKGROUND

In the prior art, various methods and apparatus have been employed to mix liquids and slurries, such as paints containing pigments which must be uniformly dispersed within the liquid base in which they are contained. In the case of paint mixing in particular, the apparatus utilized has ranged from small impellers employed as motor driven stirrers for laboratory uses to large, heavy duty, motor driven propeller type impellers used for mixing paint in 55 gallon drums and larger sizes.

In the case of the heavy duty apparatus in particular, such apparatus has typically comprised a long, flexible shaft with a propeller shaped impeller mounted at one end of the shaft and a motor drive attached at the opposite end. In some cases, where the liquids involved are particularly viscous, additional propeller type impellers have been mounted along the length of the shaft to provide additional mixing concentration points within the volume of the liquid.

In the typical heavy duty mixing apparatus of the type just described, a mixing vortex flow is created within the liquid in which liquid flow is pulled downwardly in a swirling pattern in the center of the container and then ascends back to the top of the container along the outer peripheral edges thereof. This type of descending swirling flow pattern causes the entrapment of air in the liquid being mixed, which creates a number of problems. Because the container is typically open at the top thereof during the mixing operation, the air escapes from the liquid after entrapment and produces a high concentration of fumes or, to the extent it remains entrapped for a period of time, interferes with the operation of on-site equipment, such as spray painting equipment and other dispensing equipment connected to dispense paint on-site directly from the container after mixing.

Because of environmental concerns, government regulations have increasingly required that such heavy duty paint mixing operations be carried out using covered containers. However, since access to the liquid being mixed is typically required repeatedly by the operator during the mixing operation to obtain samples and the like, operators have tended to avoid using covers provided for this purpose during mixing operations, because the covers must be repeatedly removed during the operation to gain the required access.

In addition, the above-described prior art apparatus and methods have a tendency to leave substantial amounts of unmixed pigments on the bottoms of the drums. The fact that some substantial portions of the pigments remain unmixed means that the resulting emulsion does not contain the concentration of pigment which is required, the result being a product not only of poorer quality but also one in which the color is not properly matched to the specification.

One of the objects of the present invention is to provide an improved mixing apparatus and method which overcomes the aforementioned disadvantages and which provides, in addition, a highly efficient and rapid mixing operation which has particular advantages for on-site mixing applications. Other objects and advantages of the present invention will be set forth below and will become apparent from the description herein set forth.

SUMMARY OF THE INVENTION

The present invention provides, in one embodiment thereof, an improved impeller arrangement and method of directing the flow of the liquid being mixed within a container such that the pigments and/or other particulate materials, which are initially precipitated out and usually accumulated at the bottom of the container, are rapidly and thoroughly mixed and dispersed throughout the liquid in a uniform manner such that substantially all of the particulate material is dispersed within the liquid and virtually no residue is left which has not been thoroughly mixed throughout the liquid. In addition, the present invention provides a cover mechanism, which is made to function integrally with the mixing apparatus, and which covers the container during the mixing operation to prevent the escape of any fumes or spray from the liquid being mixed. The cover mechanism is further provided with an access portion which is operable to allow ready access to the interior of the container without removal of the cover mechanism and which permits the taking of samples of the liquid being mixed well as convenient and ready access for other purposes during the mixing operation.

The improved impeller arrangement establishes a flow pattern of the liquid being mixed within the container whereby the liquid is swirled vertically downwardly along the outer periphery of the container (in the case of a cylindrical container) and then swirled upwardly at the center axis of the container to form a flow pattern which is the reverse of the customary downwardly swirling vortex at the central axis of the container. With the flow pattern so established, the liquid in the container is propelled radially inwardly across the bottom of the container from the outer periphery of the container to scrub the rapidly moving liquid across the accumulated pigment or other particulate material at the bottom of the container by means of a relatively high velocity radially inwardly directed swirl flow pattern, which then moves upward in a swirl pattern at the central axis. The flow pattern just described not only provides more rapid, complete and homogeneous mixing of the liquid and the pigment or other particulate, but it also inhibits the ingestion of air into the liquid during the mixing operation.

The above-described flow pattern is attained by a unique impeller configuration which is supported at the end of a shaft such that the entire mechanism can be driven from a motor drive mechanism formed integrally with the cover structure. The complete apparatus forms an integral structure which, for medium size containers such 55 gallon drums, can be portable and hand held and operable by a single individual operator while conforming to all applicable standards and regulations for apparatus which is to be hand held and operable by a single operator.

Further particulars are set forth below and various other advantages and objects of the invention will become apparent from the detailed description which follows, taken in connection with the accompanying drawings.

DESCRIPTION OF THE DRAWINGS

FIG. 4A is a fragmentary perspective view of the top portion of the impeller of FIG. 3 showing an alternative construction of the top portion thereof;

FIG. 5 is a side view, taken partly in cross section, of another embodiment of the present invention shown installed on a cylindrical drum.

DETAILED DESCRIPTION OF THE INVENTION

Figure 1:
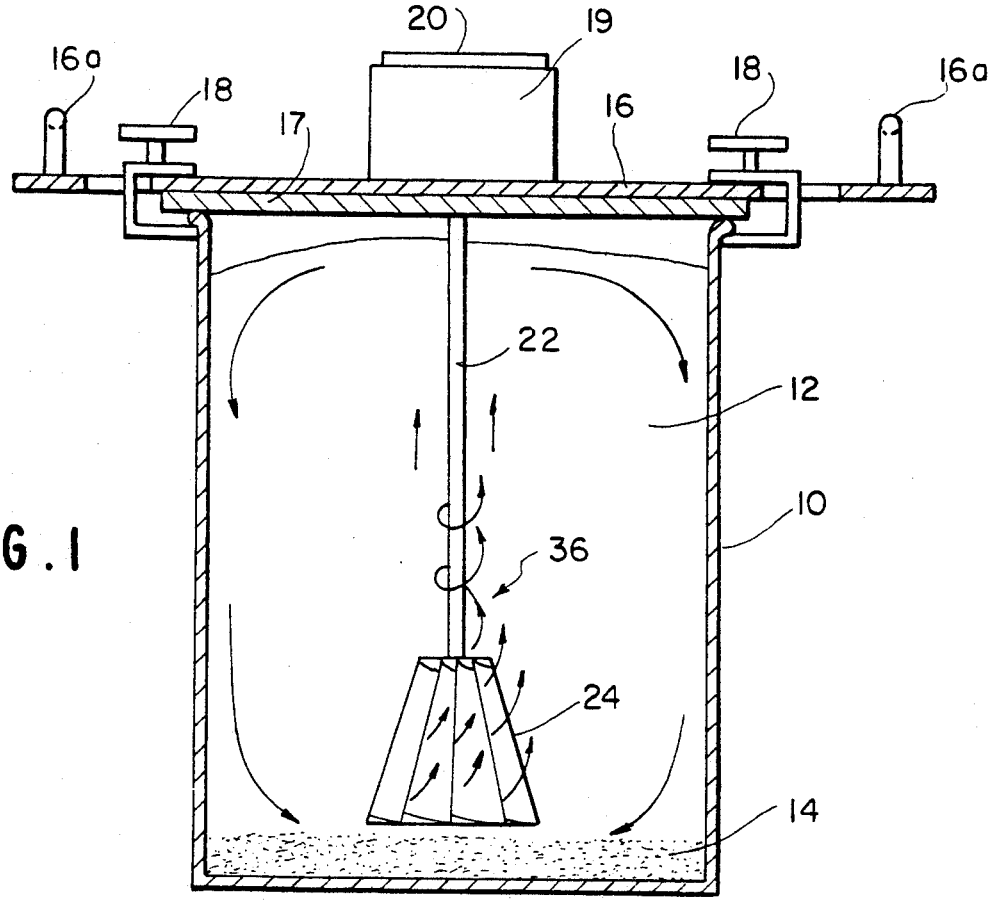
FIG. 1 is a side view, taken partly in cross section, of one embodiment of the present invention shown installed on a cylindrical drum.

Referring to FIG. 1, there is shown a cylindrical container 10 having therein a liquid 12 with a particulate material 14, such as pigment or the like, which has settled to the bottom of the container, such as would occur during storage for example, and which is to be homogeneously mixed and dispersed within the liquid 12. The container 10 as shown is of a size and shape relative to the embodiment of the invention illustrated which is typical of a 55 gallon drum.

The embodiment of FIG. 1 comprises a removable enclosure means in the form of a cover member 16 which includes a portion 17 which is circular in shape and which fits on the top of the cylindrical container 10 and engages the periphery thereof to seal the open upper end of the container. The cover member 16 is shown secured in place in the illustration of FIG. 1 by means of clamps 18 which engage the cover member and secure it to the top of the container 10 at discrete locations around the periphery thereof.

Supported on the cover member 16 is a motor drive structure 19 which includes a compressed air motor 20 together with suitable internal gearing to provide the speed ratio as appropriate in order to drive the mixing apparatus of the present invention at the proper rotational speed. The motor 20 is preferably a compressed air motor in order to provide for explosion proof operation in the presence of flammable and/or explosive liquids such as paints and the like. The motor 20 may also be an electric motor, but it is preferred in that case that it be an explosion proof electric motor for the reason just given. Extending downward from central portion of the cover member 16 is a drive shaft 22 which has mounted on the lower end thereof an impeller 24.

Figure 2:
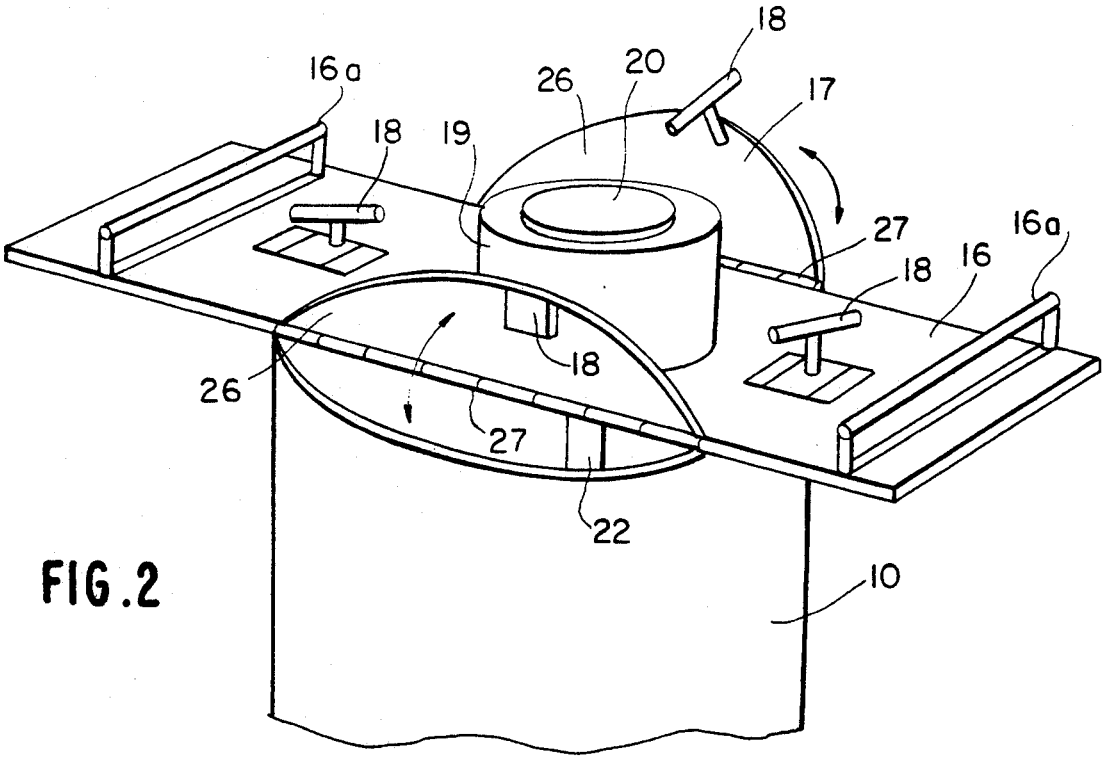
FIG. 2 is a perspective view of a portion of the embodiment of FIG. 1 showing the access portion of the cover apparatus in a partially open position.
Figure 2A:
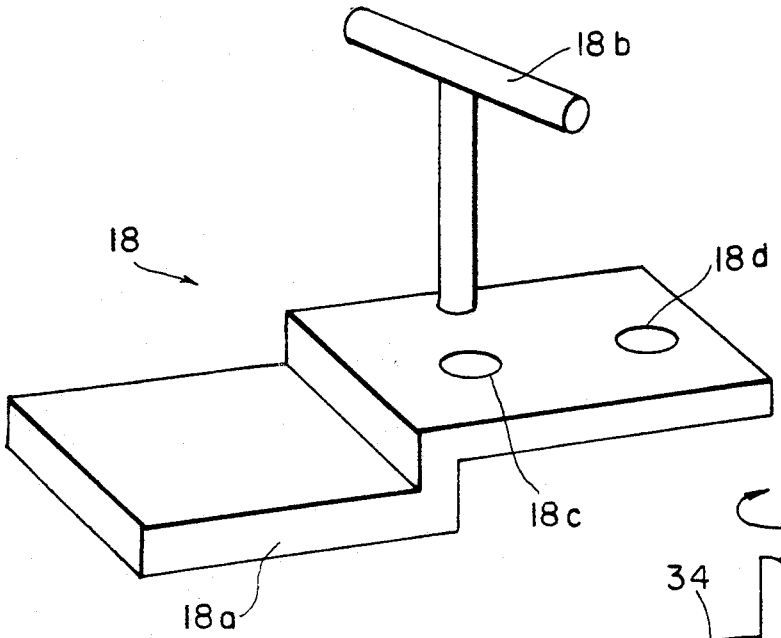
FIG. 2A is a perspective view of an alternative clamp arrangement for the embodiment of FIG. 1.

The cover member 16 includes one or more access portions 26 which are pivotally mounted on hinges 27 to the main body of the cover member as shown in FIG. 2. The access portions 26 may be pivoted upward to an open position as shown in FIG. 2 to allow access to the inside of the container 10. One or more of the clamps 18 is positioned on the access portions 26 so that the access portions may be clamped in a closed position. The clamps 18 on the access portions may then be removed or loosened to permit the access portions 26 to be pivoted to the open position shown in FIG. 2 while the remainder of the cover member 16 remains clamped in position over the opening of the container 10. The access portions 26 may thus be conveniently opened to allow access to the liquid in the interior of the container for the taking of samples and the like while the main body of the cover member 16 remains secured to the open end of the container 10. Shown in FIG. 2A is an alternative configuration of the clamps 18 in which a portion **18*a* extends downwardly for engaging the underside of the rim of the container 10 and is secured in place by a handle member 18*b* which engages a threaded portion 18*c*, through which the threaded portion of the handle member extends to engage mating threads on the cover assembly. A dowel opening 18*d* is provided for engaging a suitable locating guide dowel pin (not shown) on the cover assembly for locating and guiding the clamp member 18** in place in the assembly. Other clamp configurations are, of course, well known to those skilled in the art and may be used in a manner selected to be compatible with the particular container being employed.

Secured on the cover member 16 are handles **16*a* to permit the entire apparatus to be hand lifted onto and off of the container 10 such that the entire assembly comprising the motor drive structure 19, the elongated shaft 22 and the impeller 24**, which are connected together to form an integral assembly, forms a portable apparatus which can be hand lifted from one container to the next.

Figure 3:
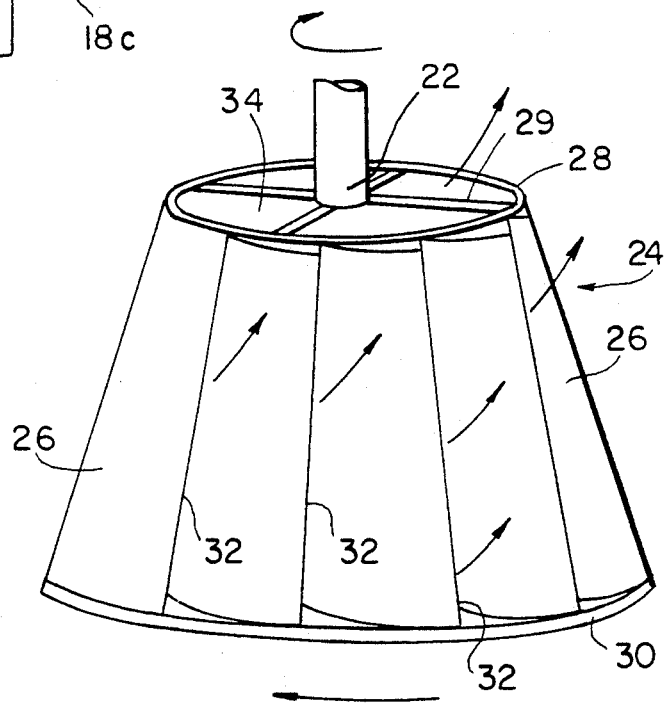
FIG. 3 perspective side view of one embodiment of the impeller structure of the present invention.
Figure 4:
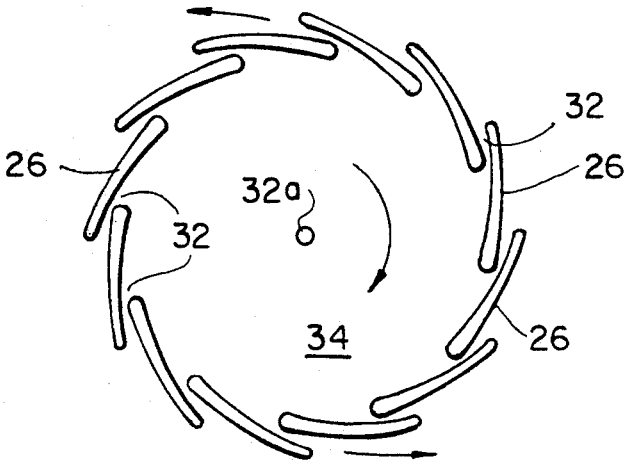
FIG. 4 is a top view of the impeller structure of FIG. 3.

The impeller 24 is uniquely shaped to provide a flow pattern within the container which efficiently, fully and rapidly homogenizes the liquid and the particulate material within the liquid in the container 10. A side perspective view of the impeller 24 is shown in FIG. 3 and a top view thereof is shown in FIG. 4. The top view of FIG. 4 is a cross section of the shape of the vanes which is taken just below the top ring 28 of FIG. 3.

The impeller 24 is formed in a generally frusto-conical shape having blades or vanes 26 secured to upper and lower supporting rings 28 and 30. In a preferred embodiment, the impeller 24 is open at the top and the bottom through the openings formed by the rings 28 and 30. The vanes 26 form elongated passages 32 therebetween which extend substantially the full length of the vanes from the top to the bottom thereof. The passages 32 extend in a peripheral direction with respect to the longitudinal axis **32*a* of the impeller 24, as best seen in the illustration of FIG. 4, to form flow passages extending from the interior 34 of the impeller 24 to the exterior thereof. The top of the impeller 24 is preferably open as shown in FIG. 3. In this structure, the shaft 22 is attached to the impeller by spokes 29 which allow spaces therebetween to accommodate the upward flow of liquid through the top of the impeller 24. As an alternative to the structure of the spokes 29, the top of the impeller 24 may be formed of a flat plate 29*a*, as shown in FIG. 4A, having holes 29*b* therein to permit the upward flow of liquid through the top of the impeller. In some cases, satisfactory results may be obtained without the use of the holes 29*b*, with the vortex flow created by the through the peripherally extending passages 32 by the vanes 26** being sufficient to provide an inverted vortex of adequate intensity for proper mixing purposes.

The impeller is positioned within the liquid in the container 10 in the bottom portion thereof as shown in FIG. 1 with the larger diameter of the frusto-conical shape being positioned on the lower side thereof near the bottom surface of the container.

The impeller 24 is rotated in the direction of the arrows as indicated in FIGS. 3 and 4 such that the passages 32 direct flow of liquid from the interior 34 to the exterior in a direction which is along the exterior periphery of the impeller and with an upward velocity component, generally as indicated by the flow arrows. That is, the relative velocity of the liquid on the exterior of the impeller is over the exit portions of the passages 32 such that liquid is drawn from the interior 34 of the impeller and exits from the flow passages 32 at the exterior of the impeller 24 with an upward swirling motion. The same pressure differential which causes the flow of the liquid from the interior 34 of the impeller 24 to the exterior through the passages also causes flow of liquid upward through the interior with a swirling motion.

Thus, a swirling upward stream of liquid is created in the center of the container by the rotation of the impeller 24, as illustrated by the rotational direction arrows and the liquid flow arrows in FIGS. 1, 3 and 4. The cross sectional area of the interior 34 of the impeller decreases in the upward direction such the flow velocity is increased through the center of the interior as the liquid is forced upward and exits from the top of the impeller as shown by the flow arrows. The impeller thus creates a swirling upward flow which is essentially an inverted vortex 36 flowing upwardly from the bottom center of the container 10.

The flow pattern created by the impeller 24 sweeps the liquid radially inwardly across the bottom of the container 10 and pulls the pigment or particulate material 14 up from the bottom of the container into the upwardly directed inverted vortex 36. Thus, while in conventional prior art mixers of the type generally used with containers of the type shown in FIG. 1, the mixing flow pattern which is created is a downward vortex descending from the top center of the liquid pool within the container, the flow pattern created by the mixing apparatus and method of the present invention is just the opposite in that the vortex flow is inverted from that just described and ascends from the bottom center through to the top center of the container 10. The level of the liquid 12 is thus typically raised in the center portion thereof as shown in FIG. 1 while the mixing operation is being carried out.

In one embodiment of the present invention, as applied to the mixing of paint in a 55 gallon drum, the impeller 24 which was utilized in that application and which provided excellent performance was approximately 7.25" in height. The diameter of the smaller upper end of the impeller was about 3" and the diameter of the larger bottom end was about 7.5". That embodiment used five slightly arcuately shaped vanes 26 and the peripheral overlap of the vanes forming the flow passages 32 ranged from about 0.5" at the top to about 0.75" at the bottom. The vanes were about 2.25" in width at the top to about 3.75" in width at the bottom. In one embodiment using an impeller of the approximate dimensions just given, the smaller diameter 3" upper end of the impeller was formed of a horizontally positioned circular flat plate as illustrated at **29*a* in FIG. 4A except without any holes or apertures 29*b* being formed therein, and satisfactory performance was also attained with this design. Other dimensions for the impeller 24 for this and other applications of the present invention will, of course, be found to be satisfactory in accordance with the teachings herein set forth. The term "vanes" as used herein means blades and/or vanes of various forms, which may be flat or arcuate in shape, and which establish the peripherally extending passages 32. Flow of the liquid over the outer surfaces of the vanes 26 and over the exit openings of the passages 32, as occurs when the impeller 24 is rotated in the direction shown by the arrows, draws the liquid from the interior of the impeller 24 through the passages 32** as explained above.

This flow pattern pulls the particulate material off of and away from the bottom of the container and into the rising inverted vortex wherein it is rapidly and thoroughly mixed. Because the vortex flows upwardly and the suction created thereby pulls upwardly from the bottom of the container instead of downwardly from the top, there is no tendency to entrain air in the flow pattern as is the case with prior art mixing apparatus. Instead, the suction of the inverted vortex pulls the particulate from the bottom of the container and is utilized to achieve more complete and more homogeneous mixing of the particulate. The flow pattern created by the frusto-conically shaped impeller 24 is thus an inverted vortex in which the liquid in the container 10 is swirled across the bottom of the container with a radial inward velocity which increases toward the center of the container and an upward velocity component which also increases in magnitude toward the center to form an upwardly directed vortex (herein referred to as an "inverted vortex") with the center of the vortex being positioned at or near the center of the container 10. The inverted vortex flow pattern thus established pulls the solid particulate material 14 away from the bottom of the container 10 and entrains it in the liquid flow.

The impeller 24 is driven by the motor 20 which turns the shaft 22 to which the impeller is attached. For a 55 gallon drum of the kind typically employed to store paint and other liquids in which suspensions of pigments and other particulate materials are to be mixed, and for liquids of medium viscosity such as paint, a motor power of about four horsepower or greater was found to provide excellent results. The level of particulate solids 14 likely to be encountered in such drum systems may vary from about one-half inch or so to about six inches or so in depth at the bottom of the container. For such applications, it has been found that positioning the impeller 24 with the bottom edge thereof about four inches or so from the bottom surface of the container 10 provides excellent mixing characteristics.

For the assembly just described, that is the embodiment as shown in FIG. 1 employing about a four horsepower motor, the entire assembly can be formed with a total weight of about 38 pounds. This weight is substantially below the presently established OSHA limit of 50 pounds for a hand lifted portable device which is to be lifted above shoulder height. The assembly can thus be used by a single operator as a portable hand lifted device.

For fluids of substantially higher viscosity, such as those having a consistency of a heavy syrup or natural honey, air ingestion is not a problem. For such applications, the embodiment of the invention as shown in FIG. 5 is particularly useful. In this embodiment, an additional impeller unit 40 is attached to the shaft 22 and positioned vertically above the first impeller 24. The second impeller 40 creates a downward flowing vortex which complements the upward flowing vortex of the impeller 24 and provides more thorough mixing for the very high viscosity liquids.

In this combination, the first impeller 24 stills acts to efficiently scrub the solid particulate material 14 from the bottom of the container 10, thereby assuring that substantially all of the material 14 will be removed from the bottom and mixed with the liquid, while the second impeller 40 serves to more thoroughly mix and distribute the solid particulate material within the high viscosity liquid. Since air ingestion is not a problem in such high viscosity liquids, the downward vortex created by the second impeller 40 does not cause difficulty in this respect and more complete and thorough mixing in such high viscosity liquids is thus provided.

Since, in the embodiments of FIGS. 1 and 5, the entire apparatus of the present invention can be clamped to the peripheral opening of the container which holds the liquid and solid particulate materials which are to be mixed, the liquid being mixed is automatically covered during the mixing process while, at the same time, the operator can gain ready access to the interior of the container for the taking of samples and the like without removing the cover from the container.

In the use of the apparatus in accordance with these embodiments, the operator has no choice other than to use the cover and covering of the liquid during the mixing process is thus assured. This avoids the escape of fumes and spray from the liquid during the mixing operation and prevents the environmental problems which are caused by such occurrences in prior art apparatus. The cover 16 also keeps airborne contaminants from entering the container and contaminating the liquid being mixed. The cover 16 further serves as a flame suppressant by limiting the volume of air which is available for combustion within the mixing zone of the container as enclosed by the cover. If a fire should occur, it is quickly smothered within the limited volume enclosed by the cover 16 within the container 10. At the same time, the operator does not encounter the inconvenience and loss of time required by prior art apparatus in which the entire cover was required to be removed in order to gain access to the interior of the container.

The unique flow pattern created by the impeller structure of the present invention provides for substantially complete removal of the particulate solid material 14 from the bottom of the container and the mixing of the solid completely and homogeneously within the liquid. This means that the intended density and uniformity of distribution of the particulate solid within the liquid is attained. In the case of paint where the solid material 14 is pigment, this assures that the intended density of the pigment throughout the liquid is attained so that the intended properties thereof are realized and also that the color of the end product meets specifications. Also, more rapid mixing is achieved with the apparatus of the present invention as opposed to prior art apparatus, thereby reducing the time required for the processing of the liquids and reducing costs, particularly in cases where such mixing steps are conducted as a part of on site operations.

It is to be understood that various changes, substitutions and changes to the embodiments herein presented will occur to those skilled in the art and that the embodiments which are described in detail herein are presented for the purpose of making a full and complete disclosure of the present invention and are not intended nor to be interpreted as limiting in any way the true scope of the invention as defined in the appended claims.

I claim:

1. A mixing apparatus for mixing a liquid and a particulate solid comprising:

impeller means for creating liquid flow mounted at one end of an elongated shaft;

a motor drive means mounted at the other end of said elongated shaft at the end thereof opposite from said impeller means;

said impeller means, said motor drive means and said elongated shaft being connected together in the form of an assembly;

support means for supporting said assembly of said motor drive means, said impeller means and said elongated shaft at the opening of a container in a position where said elongated shaft extends within said container and said impeller means is positioned near the bottom surface of said container in the region thereof where particulate material to be mixed with the liquid within the container is settled;

said impeller means comprising a frusto-conically shaped impeller unit having a larger diameter end and a smaller diameter end and having a plurality of partially overlapping vane members extending between said larger diameter end and said smaller diameter end to form an interior chamber within said impeller unit, said interior chamber being open at least at said larger diameter end of said impeller unit;

said partially overlapping vane members forming elongated passages therebetween at the overlapping portions thereof extending between said larger and smaller diameter ends and connecting the interior of said impeller unit and the exterior thereof; and said impeller unit being positioned with the longitudinal axis thereof extending vertically and with said larger diameter end thereof located at the bottom extremity of said assembly.

2. A mixing apparatus as set forth in claim 1 including a cover means formed in a shape to substantially cover the opening of said container at which said assembly is supported, said cover means being connected to and forming a part of said assembly.

3. A mixing apparatus as set forth in claim 2 in which said assembly includes handle means for accommodating hand lifting of said assembly, whereby said assembly forms a hand liftable, portable assembly.

4. A mixing apparatus as set forth in claim 2 in which said cover means includes a movable access closure member supported on said cover means and movable between open and closed positions to form with said cover means a closure for said opening in said closed position and to define an access opening to the interior of said container in said open position.

5. A mixing apparatus as set forth in claim 1 including a second impeller means for creating liquid flow mounted on said elongated shaft between said motor drive means and said impeller means mounted at the end of said elongated shaft.

6. A mixing apparatus as set forth in claim 5 in which said second impeller means comprises a frusto-conically shaped second impeller unit having a larger diameter end and a smaller diameter end and having a plurality of partially overlapping vane members extending between said larger diameter end and said smaller diameter end to form an interior chamber within said second impeller unit, said interior chamber in said second impeller unit being open at least at said larger diameter end of said second impeller unit;

said partially overlapping vane members forming elongated passages therebetween at the overlapping portions thereof extending between said larger and smaller diameter ends and connecting the interior of said second impeller unit and the exterior thereof; and said second impeller unit being positioned with the longitudinal axis thereof extending vertically and with said larger diameter end thereof facing upward toward said motor drive means.

* * * * *